United States Patent [19]

Sugihara

[11] Patent Number: 4,761,863

[45] Date of Patent: Aug. 9, 1988

[54] STRUCTURE OF SNAP

[75] Inventor: Kouki Sugihara, Tokyo, Japan

[73] Assignee: Scovill Japan Kabushiki Kaisha, Tokyo, Japan

[21] Appl. No.: 15,045

[22] Filed: Feb. 17, 1987

[30] Foreign Application Priority Data

Mar. 4, 1986 [JP] Japan ..... 61-30109[U]

[51] Int. Cl.[4] ..... A44B 1/18

[52] U.S. Cl. ..... 24/692; 24/90 E; 24/113 MP

[58] Field of Search ..... 24/692, 687, 682, 621, 24/622, 623, 90 E, 108, 90 A, 113 MP, 90 HA

[56] References Cited

U.S. PATENT DOCUMENTS

| | | | |
|---|---|---|---|
| 434,802 | 8/1890 | Perry | 24/108 |
| 3,159,890 | 12/1964 | Jensen | 24/692 |
| 3,213,507 | 10/1965 | Christian et al. | 24/682 |
| 3,725,980 | 4/1973 | Burgio | 24/90 E |
| 3,925,860 | 12/1975 | Furuya | 24/687 |
| 4,457,050 | 7/1984 | Kanzaka | 24/108 |
| 4,580,320 | 4/1986 | Takata | 24/113 MP |
| 4,606,095 | 8/1986 | Lam et al. | 24/90 E |

FOREIGN PATENT DOCUMENTS

| | | | |
|---|---|---|---|
| 2414312 | 10/1975 | Fed. Rep. of Germany | 24/90 HA |
| 327059 | 2/1958 | Switzerland | 24/113 MP |
| 541524 | 12/1941 | United Kingdom | 24/623 |

*Primary Examiner*—Victor N. Sakran

*Attorney, Agent, or Firm*—Wood, Dalton, Phillips, Mason & Rowe

[57] ABSTRACT

A plastic stud or socket of a snap comprising a stud or socket body with a flange having an annular groove formed at the bottom. The groove is reversely tapered outward, or downward, and open at the bottom of the flange so as to receive a plurality of clinchable prongs of a backing member for attachment to an article of clothing or the like. In another aspect, the radially inner and outer sidewalls of the annular groove in the flange extend outwardly to form projecting edges respectively.

9 Claims, 1 Drawing Sheet

STRUCTURE OF SNAP

BACKGROUND OF THE INVENTION

This invention relates to a plastic snap, and more specifically to a structure of the bottom of a plastic stud or socket thereof.

Snaps made wholly of plastics have enjoyed widespread use because of the ease of fabrication, colorability, light weight, and other advantages rarely offered by metal snaps. However, plastic snaps have a disadvantage in common; the lack of strength with which they take hold of the article of clothing or the like being snapped. This results from the low absolute strength of plastics. To eliminate the disadvantage, varied attempts have been made to attach the snaps securely, but they still leave problems unsettled from the viewpoint of appearance or ease of attachment.

One such attempt is illustrated in FIG. 1, where a backing member 3 has only one leg or prong 3 in the center. The prong 1 pierces an article of clothing or the like and enters a hollow stud 2 through its center hole and is clinched in the bottom. In this case, the diameter of the prong 1 is limited by the inside diameter of the hollow shank 4 of the stud 2. With a flexible article of clothing or the like, such as knitted fabric, the stud-backing member combination cannot effectively hold it irrespective of its stretching and shrinkage. For these and other reasons, the strength of the stud as attached in place is not deemed satisfactory.

In another instance of the prior art, as illustrated in FIG. 2, a plurality of prongs 1' formed on the base of a backing member 3' are inserted through a plurality of holes 6 correspondingly formed in a flange 5 of a stud 2'. In this way the stud is securely attached to the article of clothing or the like, but the clinched and deformed ends of the prongs 1' exposed on the holes mar the appearance. Moreover, the structure renders it difficult to bring the prongs 1' of the backing member and the stud holes 6 in proper register. Adoption of a square rather than circular shape in an attempt to overcome the difficulty, as in FIG. 4, again presents an appearance problem.

SUMMARY OF THE INVENTION

The present invention is aimed at providing a novel stud or socket of a snap which remedies the aforedescribed disadvantages of the all-plastic snaps in use.

According to the invention, a plastic stud or socket of a snap has an annular groove formed at the bottom concentrically with the circumference thereof, the groove being reversely tapered outward and open at the bottom.

In another aspect of the invention, the radially inner and outer sidewalls of the annular groove extend outwardly (away from the level of opening) to form projecting edges respectively. The backing member to be combined with the stud or socket is of a multi-pronged type. When the backing member is to be secured to a stud or socket, its prongs readily fit into the annular groove without difficulty in registering and is plastically deformed by clinching to fill up the groove locally. The clinching, at the same time, forces the projecting edges against the article of clothing or the like, causing them to bend toward each other by plastic deformation. The plastically deformed projecting edges take a firm hold of the shanks of the prongs and thereby add to the resistance of the backing member to its own falling off from the annular groove.

BRIEF DESCRIPTION OF THE DRAWINGS

FIG. 7 is a cross sectional view of a stud of the invention and a conventional pronged backing member joined through an article of clothing or the like.

DESCRIPTION OF THE PREFERRED EMBODIMENTS

Preferred embodiments of the present invention will be described in detail below with reference to the accompanying drawings.

Figure 1:
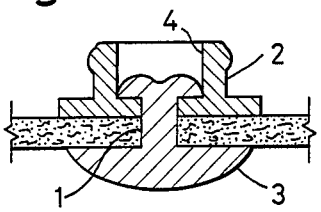
Fig. 1 Prior Art
FIG. 1 is a cross sectional view of a conventional combination of stud and backing member jointly attached to an article of clothing or the like by a single center prong of the backing member.
Figure 2:
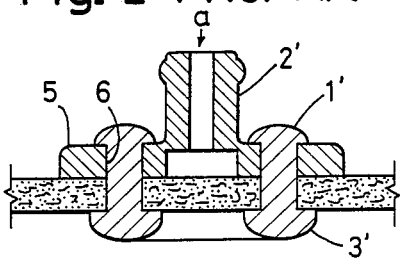
Fig. 2 Prior Art
FIG. 2 is a cross sectional view of a conventional combination of stud and backing member jointly attached to an article of clothing or the like by a plurality of prongs of the backing member inserted through holes in a flange of the stud.
Figure 3:
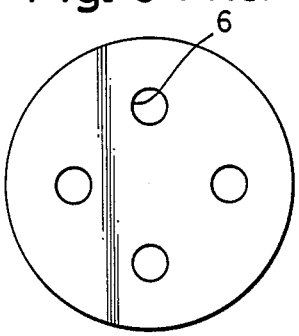
Fig. 3 Prior Art
FIG. 3 is a top view as seen in the direction of the arrow a in FIG. 2.
Figure 4:
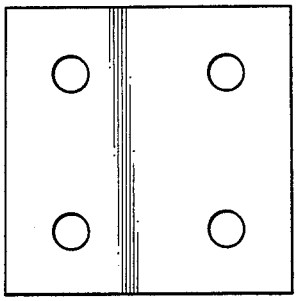
Fig. 4 Prior Art
FIG. 4 is a view similar to FIG. 3 but showing that the stud used has a square flange.
Figure 5:
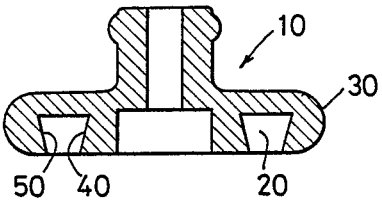
FIG. 5 is a cross sectional view of a stud embodying the present invention which has an annular groove reversely tapered and open at the bottom.
Figure 6:
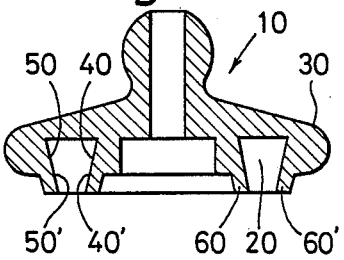
FIG. 6 is a cross sectional view of another embodiment of the stud of the invention.

FIG. 5 is a cross sectional view of a stud with a bottom structure according to the invention. The stud 10 has a flange 30, the underside of which is formed with an annular groove 20 concentric with the circumference of the flange. As viewed in FIG. 5, the radially inner sidewall 40 and radially outer sidewall 50 of the annular groove 20 are convergent downwardly to provide a reverse taper. In a more preferred embodiment shown in FIG. 6, the opening edges of the radially inner and outer sidewalls of the annular groove 20 are extended downwardly to form integrally an inner projecting edge 60 and an outer projecting edge 60'. The inner surface 40' of the inner projecting edge 60 and the inner surface 50' of the outer projecting edge 60', both extended from the annular groove 20, are preferably tapered likewise as extensions of the reverse taper of the groove 20.

Figure 7:
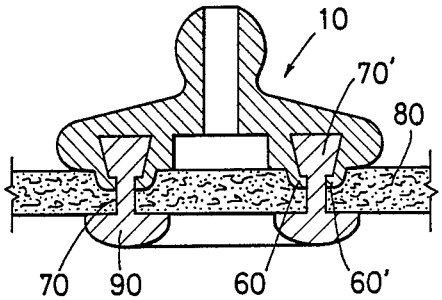

FIG. 7 is a cross sectional view of a snap stud 10 of the present invention secured to a fabric or the like with a conventional multi-pronged backing member 90 of plastic. In attaching the stud 10 of FIG. 6 to an article of clothing or the like 80, for example, the prongs 70 of the backing member 90 are caused to pierce the article until they fit in the annular groove 20 of the stud 10. The prongs are then clinched under pressure within the annular groove 20 so that they are plastically deformed to fill up the groove as at 70', in the same manner with the two examples of the prior art. The clinching force thus exerted on the embodiment of FIG. 6 also crimps the projecting edges 60 and 60' toward each other, plastically deforming them similarly to grip the prongs 70 in between. Thus, the prongs plastically deformed in the annular groove 20 are secured in position by the reverse taper of the groove 20 and also by the grip of the plastically deformed projecting edge 60 and 60'. This doubles the resistance of the backing member 90 to its own falling off from the stud, downwardly as viewed in FIG. 7, with a consequent increase in the strength with which the stud is secured to the article of clothing or the like. In any event, the stud presents a neat and smart appearance because the prongs are invisible from the outside. The embodiment shown in FIG. 6 attains greater strength of attachment than that of FIG. 5.

While the present invention has been described in connection with preferred embodiments thereof, it should be noted that various changes and modifications may be made without departing from the spirit of the invention.

What is claimed is:

1. A plastic stud of a snap comprising a stud body with a flange having an annular groove formed at the bottom, the groove being convergent outwardly to provide a reverse taper, and open at the bottom of the flange so as to receive a plurality of clinchable prongs of a backing member for attachment to an article of clothing or the like, the backing member being made of plastic, and the prongs being adapted to be plastically deformed within the annular groove by a clinching force exerted at the time of joining the backing member to the stud.

2. A stud according to claim 1 wherein the radially inner and outer sidewalls of the annular groove in the flange extend outwardly to form projecting edges respectively.

3. A stud according to claim 2 wherein the opposing inner surfaces of the edges projecting from the radially inner and outer sidewalls of the annular grooves are tapered in the same way as the sidewalls themselves.

4. A stud according to claim 2 wherein the projecting edges are plastically deformed and crimped toward each other by the clinching at the time the snap is attached to an article of clothing or the like.

5. A plastic stud of a snap comprising a stud body with a flange having an annular groove formed at the bottom and including radially inner and outer side walls extending outwardly to form projecting edges respectively, the groove being convergent outwardly to provide a reverse taper, and open at the bottom of the flange so as to receive a plurality of clinchable prongs of a backing member for attachment to an article of clothing or the like, the backing member being made of plastic, and the prongs being adapted to be plastically deformed within the annular groove by a clinching force exerted at the time of joining the backing member to the stud.

6. A plastic snap fastener member and a backing member in combination, said snap fastener member being provided with a flange having an annular groove formed at the bottom, the groove being convergent outwardly to provide a reverse taper, and open at the bottom of the flange so as to receive a plurality of clinchable prongs of the backing member for attachment to an article of clothing, the backing member being made of plastic, and the prongs being adapted to be plastically deformed within the annular groove by a clinching force exerted at the time of joining the backing member to the snap fastener member.

7. A plastic snap fastener member and a backing member in combination according to claim 6, wherein the radially inner and outer sidewalls of the annular groove in the flange extend outwardly to form projecting edges respectively.

8. A plastic snap fastener member and a backing member in combination according to claim 7, wherein the opposing inner surfaces of the edges projecting from the radially inner and outer side walls of the annular groove are tapered in the same way as the side walls themselves.

9. A plastic snap fastener member and a backing member in combination according to claim 7, wherein the projecting edges are plastically deformed and crimped toward each other by the clinching at the time the snap is attached to an article of clothing.

* * * * *